US005090893A

United States Patent [19]

Floriot

[11] Patent Number: 5,090,893

[45] Date of Patent: Feb. 25, 1992

[54] CHILDPROOF GAS LIGHTER

[75] Inventor: Marcel Floriot, Toussieu, France

[73] Assignee: Cricket, Rillieux-la-Pape, France

[21] Appl. No.: 651,332

[22] PCT Filed: Apr. 5, 1990

[86] PCT No.: PCT/FR90/00244

§ 371 Date: Feb. 7, 1991

§ 102(e) Date: Feb. 7, 1991

[87] PCT Pub. No.: WO90/12254

PCT Pub. Date: Oct. 18, 1990

[30] Foreign Application Priority Data

Apr. 7, 1989 [FR] France ..... 89 04870

[51] Int. Cl.[5] ..... F23D 11/36

[52] U.S. Cl. ..... 431/153; 431/254; 431/276

[58] Field of Search ..... 431/153, 276, 277, 254

[56] References Cited

U.S. PATENT DOCUMENTS 4,830,603 5/1989 Cirami ..... 431/153
4,832,596 5/1989 Morris ..... 431/153
5,002,482 3/1991 Fairbanks et al. ..... 431/153

FOREIGN PATENT DOCUMENTS 296281 12/1988 European Pat. Off. .
90/00239 1/1990 European Pat. Off. ..... 431/277

*Primary Examiner*—Carroll B. Dority
*Attorney, Agent, or Firm*—Herbert Dubno; Andrew Wilford

[57] ABSTRACT

This lighter is of the type having on its housing in which is provided a reservoir containing the gas in liquid form a head comprising in addition to the burner valve (10) connected with the reservoir via a pressure reducer an igniting mechanism comprising control means (4) for the opening of the burner valve (10) and means for making sparks (2, 3, 4, 8, 11) and in which associated with the igniting mechanism is means (8) for neutralizing this mechanism and displaceable between an active neutralizing position for the igniting mechanism and a retracted position, these neutralizing means (8) being displaceable manually by the user from their active position to the retracted position. The neutralizing means (8) of the igniting mechanism are normally maintained in the neutralizing position and are in addition set up so as to be automatically returned to the neutralizing position after actuation of the igniting mechanism.

3 Claims, 7 Drawing Sheets

FIG_5
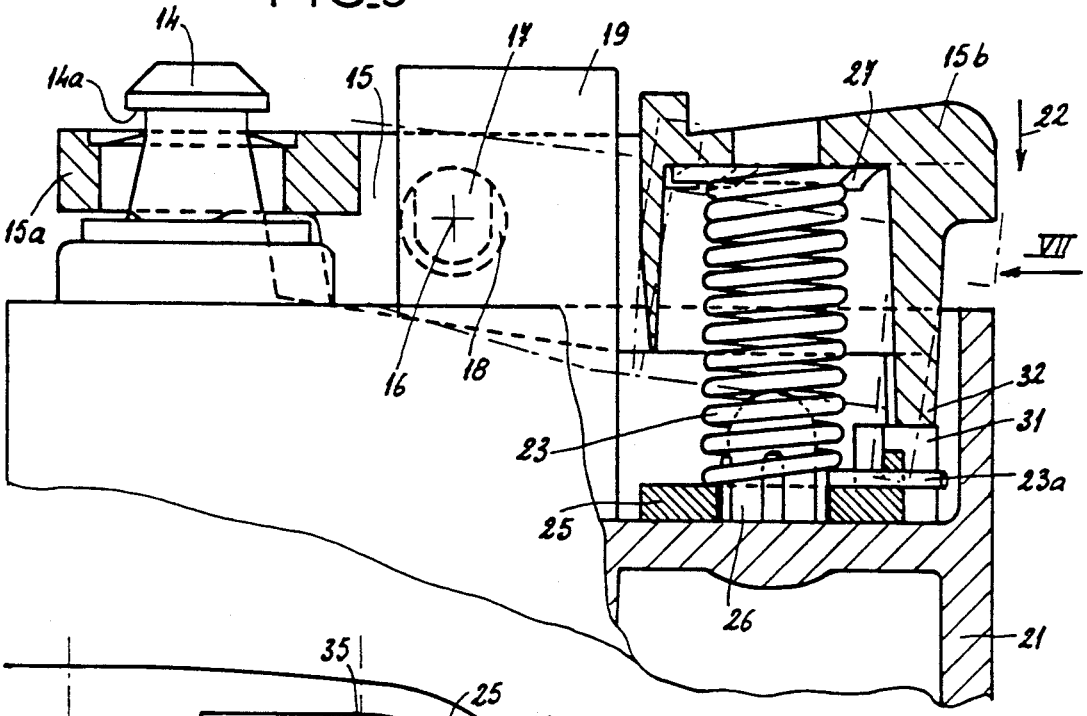
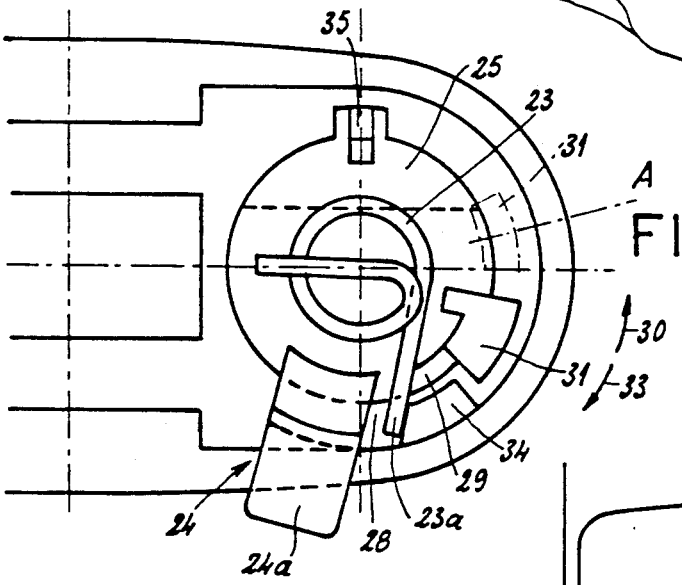
FIG_6
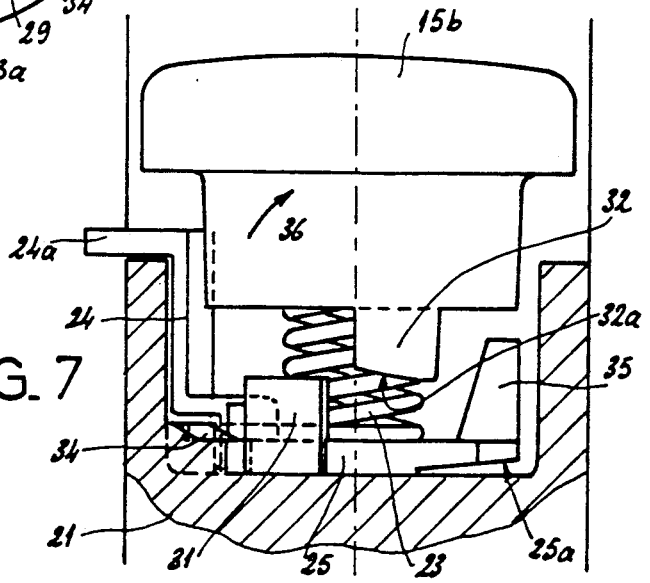
FIG_7

CHILDPROOF GAS LIGHTER

FIELD OF THE INVENTION

The present invention relates to a childproof gas lighter of the type having in its housing, in which is formed a reservoir containing the gas in liquid form, a head comprising in addition to the burner valve connected to the reservoir via a pressure reducer an igniting mechanism comprising control means for opening the burner valve and means for making sparks.

BACKGROUND OF THE INVENTION

In known lighters of this type after each actuation of the control button the intermediate link piece is returned automatically to its service position, that is coupled with the associated operating element.

The result is that it is very dangerous to leave this type of lighter within reach of a child who can without any difficulty ignite it.

In order to avoid this serious disadvantage it has been proposed to make childproof lighters, that is lighters in which associated with the igniting mechanism is means for neutralizing this mechanism movable between an active neutralizing position in which it impedes actuation of the igniting mechanism and a retracted position in which it permits such actuation, these movable means being displaceable manually by the user from the actuatable service position to the retracted position.

This type of lighter is known in particular from European Patent Document EP A1 296,281. Nonetheless in all these lighters a neutralizing means is not set up so as to be automatically returned to the actuatable neutralizing position after actuation of the igniting mechanism.

This return to the use position can only be obtained by a specific maneuver in the opposite direction by the user.

It is therefore easy to imagine that simply forgetting same completely eliminates the advantages associated with the presence of the neutralizing means.

OBJECTS OF THE INVENTION

It is therefore an object of the present invention to provide an improved lighter.

Another object is to avoid the above-described disadvantages of the known lighters.

SUMMARY OF THE INVENTION

To attain these objects in the lighter of the invention which is of the above-described type the neutralizing means of the igniting mechanism is normally held in the neutralizing position and is in addition set up to be automatically returned to the neutralizing position after operation of the igniting mechanism.

To ignite this lighter it is therefore necessary to know the move to do to retract the blocking means which, evidently, is not possible for a child. In addition after use the user does not need to move the neutralizing means back because its return to the service position is automatic.

In the type of lighter according to the invention the igniting mechanism generally comprises means for controlling opening of the burner valve and means for making sparks set up to be operated simultaneously of the latter immediately after the former or inversely. These means can be mechanically independent from each other or can be associated with the same control element.

No matter what the relationship between the means for controlling the opening of the burner valve and the means for making sparks, in the lighter according to the invention it is necessary and sufficient that the neutralizing means act on at least one of the cited means, that is on the means for controlling ling the opening of the valve or on the means for making sparks. There is known for example from U.S. Pat. No. 3,827,852 a lighter in which the means for making sparks is constituted by a flint and a wheel whose drive element is formed by a disk having an edge toothing and intended to act as a ratchet capable of being rotated by means of a depressible control button against the force of a helical return spring and via a link piece forming the capacity of a pawl, wherein the link piece is formed by a straight extension of the upper end of the return spring of the control button and in which the means for controlling the opening of the valve is formed by a lever actuatable by the control button at the end of its depression.

In such a lighter according to the invention the helical return spring of the control button is free to rotate around its rotation axis and the straight extension of its upper end is bent to form an elbow whose centerline lies on a plane perpendicular to the direction of travel of the button and where the end of the free arm, which projects outward through a slot formed in the side wall of the control button, is freely displaceable in this slot, each of these displacements corresponding to a rotation of the helical return spring of the button, the other arm of this elbow being movable on movement of the above-mentioned end of the free arm into engagement with the tooth of the edge toothing of the drive element, the escape flanks of the teeth of this toothing causing the reverse displacement of the elbow until it is in its retracted position on return of the control button to the upper rest position under the force of its return spring.

According to another feature of the invention the slot formed in the side wall of the control button is delimited by two opposed rows of staggered teeth. This formation considerably facilitates molding of the control button without impeding the displacement of the elbow.

In another lighter of the same type such as is known from the above-cited European E.P. A1 296,281 the control means for opening the valve is formed by a rocking lever pivotal on a fixed axis orthogonal to the axis of the burner valve and having one arm formed like a fork or elastic crown engaged under a collar of the burner valve and whose other operating arm is intended to be operated by the user by being pushed in a direction toward the housing of the lighter against the force of a return spring, the means for making sparks being themselves independent or associated with the control lever for opening the valve.

In this lighter the means for neutralizing the pivotal control lever for opening the burner valve is formed by a lever rocking about an axis parallel to that of the burner valve between two extreme positions—operated for neutralization and retracted—under the operating end of the rocking lever.

According to this invention a return spring is associated with the rocking lever carrying at least a first non-axial projection extending toward the lower face of the operating end of the rocking lever and positioned angularly such that when the blocking lever is in the actuated position it is aligned with a complementary projection or second projection of the above-mentioned end of the rocking lever such that in this actuated position of the blocking lever this first projection is situated just below the complementary projection and opposes any operation of the rocking lever, means being provided to allow the blocking lever to be pivoted into the inactive position so as simultaneously to neutralize its return spring so long as the rocking lever has not been actuated to control the opening of the valve, other means being provided to free it as soon as the rocking lever has been operated.

According to a simple embodiment of the invention the return spring of the blocking lever is formed by a radial extension of the end in contact with the housing of the lighter of the helical return spring of the rocking lever whose other end is rotationally blocked by engagement against the lower face of the operating end of this rocking lever, this projection being continuously engaged in a longitudinal notch formed to this end in the section of the cylindrical skirt formed by the blocking lever concentric with its rotation axis whereas the housing of the lighter has a projection formed like a cam in the path of the above-mentioned radial projection of this spring and having a flank capable of permitting this projection to pass by when the blocking lever is operated in a direction toward its retracted position and to retain it after passing this flank, means being provided to permit the disengagement of the radial projection of the spring with respect to the cam-shaped projection during actuation of the rocking lever.

According to an advantageous embodiment of the invention the means freeing the return spring from the blocking lever and disengaging it from the cam shaped projection comprises basically a boss carried on the hub of the blocking lever positioned under the operating end of the rocking lever at a location diametrically opposed to the notch holding the radial projection of the return spring and intended to permit rocking of the blocking lever when the return lever is actuated and to thus start the lifting of the radial extension of the return spring of the blocking lever above the level of the flank of the cam-shaped projection so as to permit by freeing it the return of the blocking lever to the service position after releasing the pivotal control lever for opening the valve.

According to a variant of this embodiment of the invention, that is with respect to a lighter whose control means for opening the valve by a rocking lever is associated with means for neutralizing the igniting mechanism, this means is formed by a slide positioned under the operating end of the rocking lever and movable parallel to the longitudinal axis of this rocking lever between a actuated position in which it projects with respect to the service end of the lever and a retracted position in which it is retracted toward the other end of the rocking lever, this slide being provided with guide means relative to the housing of the lighter having the shape of a horseshoe whose elastic legs carry a boss normally provided under a skirt bounding the service end of the rocking lever so as to impede rocking thereof in a direction to open the burner valve, the converging complementary flanks being formed on the inside faces of the side walls of the housing of the lighter and on the external faces of the arms of the slide to reduce the spacing of their bosses when the slide is moved into the retracted position so as to completely free the path of the skirt of the use end of the rocking lever while the transverse leg of the slide and the rear outside face of the skirt of the service end of the rocking lever have complementary flanks of the same slope that can cooperate with each other when this end of the rocking lever is pushed in to move the slide in the opposite direction into its actuated neutralizing position.

For example the guide means of the slide in the housing of the lighter are formed by central medial leg provided with a longitudinal aperture engaged on a shoulder of the same width as itself that is provided on pin carried by the housing of the lighter.

Advantageously the guide pin of the slide is the one which serves to center the return spring of the rocking lever, the diameter of the shoulder being greater than that of the passage of this spring so as to form an abutment for it. Thus the spring does not bear directly against the central leg of the slide so that it does not impede its operation.

DESCRIPTION OF THE DRAWING

In any case the invention will be better understood with the help of the description which follows, reference being made to the annexed schematic drawing showing by way of non-limiting examples two embodiments of the lighter:

FIG. 5 is a side elevation view partly in section of a second embodiment of this lighter;

FIG. 6 is a partial top plan view of the lighter of FIG. 5;

FIG. 7 is a partial view partly broken away of the lighter of FIG. 5 taken in the direction of arrow VII of FIG. 5;

SPECIFIC DESCRIPTION

Figure 1:
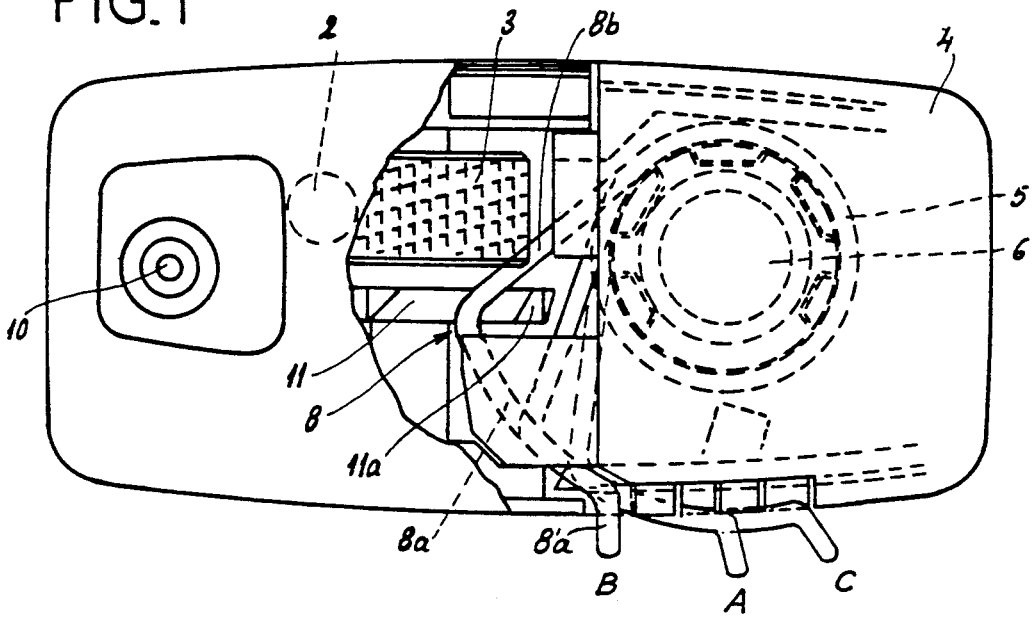
FIG. 1 is a top plan view of a first embodiment of the lighter with the cap covering the head broken away.

The lighter illustrated in FIG. 1 through 4 of the drawing is a gas lighter whose igniting mechanism is of the type having a flint 2 and a wheel 3. The igniting mechanism of this lighter is more particularly of the type described in above-cited U.S. Pat. No. 3,827,852 in which rotation of the wheel is obtained by pushing down a control button 4 against the force of a helical return spring 5 which is associated with it via a link piece between the button 4 and the drive element or driver of the wheel 3. This spring 5 surrounds a vertical pin 6 unitary with the lower face of the button 4 and serving as its guide with respect to a housing 7 of the lighter. Pushing down the button 4 has the simultaneous effect of opening the control valve for gas feed whose support stem is generally constituted by the burner 10. To do this the button 4 acts on the burner valve 10 via a lever that is not shown in the drawing.

In a patent described in this earlier U.S. patent the upper end of the helical spring 5 is provided with a straight horizontal extension normally maintained engaged against one of the teeth of the edge toothing of a ratchet forming the guide element of the wheel 3. In this patent the helical spring 5 is blocked against rotation by engagement of its other end in a recess formed to receive it in the housing of the lighter so that the upper extension described above is always engaged with the toothing of the ratchet and an pushing down of the button 4 makes a jet of sparks by rotating the wheel 3 in contact with the flint 2 and, simultaneously, opens the control valve for the gas feed.

In order to eliminate the risks inherent in this type of lighter according to the invention on the one hand the helical spring 5 is mounted so that it can rotate freely about the guide pin 6 of the button 4 and on the other hand the straight horizontal extension 8 of the upper end of the spring 5 is bent to form an elbow whose free arm 8*a* has a free end 8'*a* projecting outward through a slot 9 formed in the side wall of the control button 4. This free end 8'*a* of the arm 8*a* of the elbow 8 can be displaced manually from one end to the other of the slot 9, the freedom of rotation of the helical spring 5 about the pin 6 permitting these displacements.

FIG. 1 shows the end 8'*a* of the arm 8*a* of the elbow 8 in three positions, that is two end positions B and C and an intermediate position A. As shown in this figure when the end 8'*a* of the free arm 8*a* of the elbow 8 is in position B, the other arm 8*b* of the elbow 8 is then engaged in one of the teeth of the edge toothing 11*a* of the ratchet constituted by the driver 11 of the wheel 3. In this position pushing down the button 4 inevitably causes the lighter to ignite by rotating the ratchet 11 and the wheel 3 on one hand and by opening the burner valve 10 on the other. On the other hand in the two other positions A and C of the end 8'*a* of the free arm 8*a* of the elbow 8, the arm 8*b* is retracted, that is to say out of the path of the toothing 11*a* of the ratchet 11.

The result is that in these positions operating the control button 4 has no effect with respect to the driver 11 and the wheel 3.

Operation of this lighter is as follows:

No matter what the position of the free end 8'*a* of the arm 8*a* of the elbow 8 it is necessary before pushing down the control button 4 to move it into its position B so as to engage the arm 8*b* in one of the teeth of the toothing 11*a* of the ratchet 11. In this position of the elbow 8, pushing down the control button 4 thus has the effect of pivoting by a fraction of a revolution the driver 11 and the wheel 3 and of simultaneously opening the inlet of gas by acting on the burner valve 10. When the button 4 is at the bottom end of its travel and has been released by the finger of the user, its return spring 5 pushes it back up into its starting position and as it goes up the disengagement flank of the tooth of the toothing 11*a* which is just below the arm 8*b* of the elbow 8 pushes it back into position A in which it is retracted with respect to the toothing 11*a*.

The result is therefore that after each actuation of the button 4 the intermediate linking piece which is formed by the elbow 8 is automatically returned to its nonoperating position with respect to the driver 11. In order to move this intermediate link piece formed by the elbow 8 into its service position, that is to say into the position in which its arm 8*b* is engaged with a tooth of the toothing 11*a*, it is necessary to move the free end 8'*a* of its arm 8*a* from the position A to the position B. This displacement takes place only by an intentional movement from the user and there is little risk that it will be produced by an unknowing child.

In order to reduce the risks of an inappropriate displacement of the elbow 8 into its service position B, according to the embodiment shown in the drawing, the notch 9 has such a length that it allows the free end 8'*a* of the arm 8*a* of the elbow 8 to be brought into an end position C which is even further from the position B than the position A.

Figure 2:
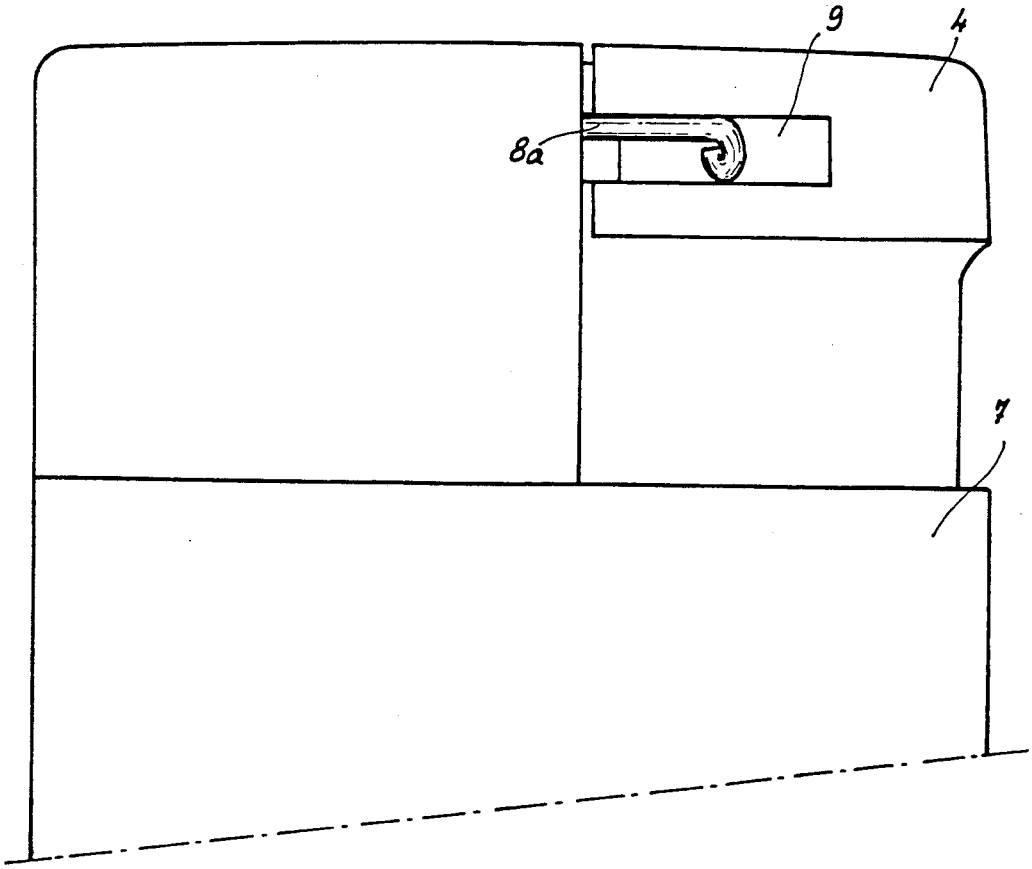
FIG. 2 is a side elevational view of the upper part of the lighter of FIG. 1.

In FIG. 2 the free end 8'*a* of the arm 8*a* of the elbow 8 is accessible from outside via a slot 9 of standard type.

Figure 3:
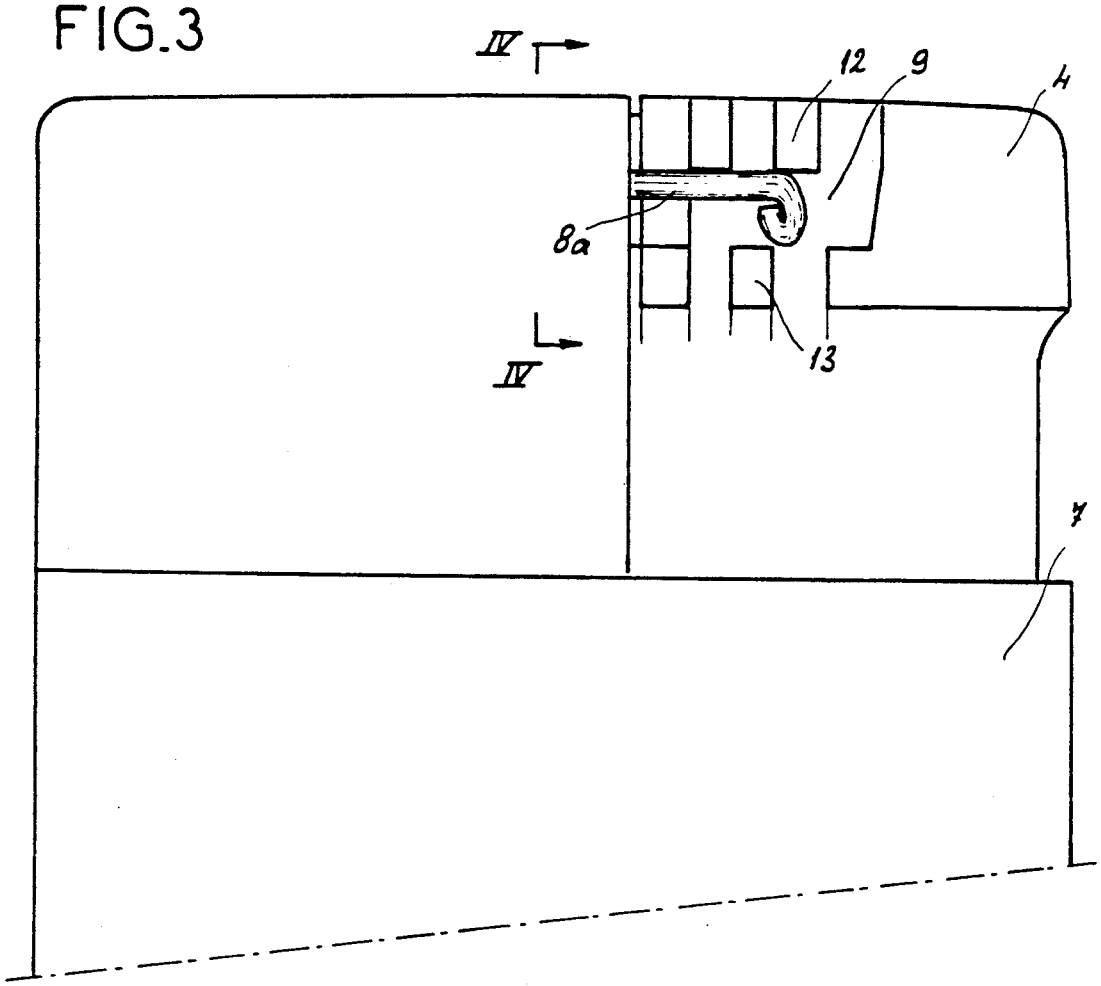
FIG. 3 is a view like FIG. 2 showing a particular embodiment of the lighter of FIGS. 1 and 2.
Figure 4:
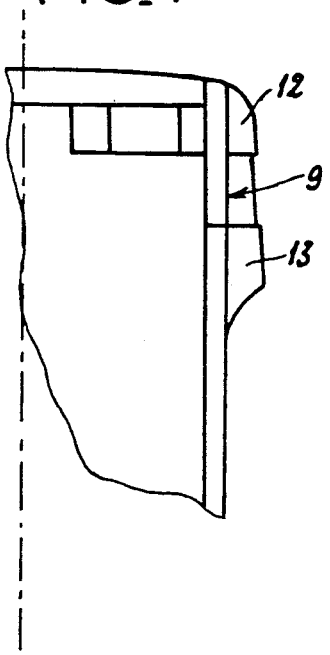
FIG. 4 is a partial section taken along line IV—IV of FIG. 3.

FIGS. 3 and 4 show an interesting embodiment of this slot 9, an embodiment according to which this slot is delimited along its two longitudinal edges by two opposite rows of teeth 12 and 13, whose reason for existence is to facilitate demolding of the button 4 which is generally made of an injected plastic material. To this end it is sufficient to eliminate any problem of demolding to form the teeth 12 of the upper row staggered with respect to the teeth 13 of the lower row.

It is important to note that the operation of this lighter only requires one hand because with the thumb the user can displace the end 8'*a* of the elbow 8 into its position B and immediately thereafter can push down the control button 4.

The lighter shown in FIG. 5 through 8 is of the type in which the means for controlling opening of the burner valve 14 is formed by a rocking lever 15 pivoted on an axis 16 fixed and orthogonal to the axis of the burner valve 14 by means of two gudgeons 17 that it carries on the sides of its middle part and which are engaged in sockets 18 formed in a cover whose sides 19 are unitary with the housing 21 of the lighter. One end 15*a* formed as an elastic ring of this lever 15 is engaged under a collar 14*a* of a burner valve 14 so as to be able to control by lifting the burner valve 14 the opening of the valve when the other end or service end 15*b* of the lever 15 is pushed in the direction toward the housing 21 of the lighter as shown by arrow 22.

A helical spring 23 interposed between the housing 21 of the lighter and a lower face of the service end 15*b* of the lever 15 constantly urges this end away from the housing 21 to return the burner valve 14 into the closed position of the valve.

In the drawing there is no illustration of the means for making sparks. These means can quite simply be of the type with a flint and a wheel, the wheel and its drivers being carried by an axle coaxial to the rocking axis 16 of the lever 15 so that at the end of actuation of the wheel the thumb of the user falls on the service end of the lever 15*b* thus opening the burner valve 14 immediately after the production of sparks.

In this lighter the means for blocking the igniting mechanism is set up to oppose actuation of the rocking lever 15 serving to control opening of the burner valve 14. It is easy to see that if the lever 15 is blocked, even if the spark-making means can be actuated freely, that will be inconsequential because the burner valve of 14 cannot be brought to the open position.

In the example illustrated in the drawing the means for neutralizing the igniting mechanism is constituted by a lever 24 whose normal function is to block the lever 15 in a position with the burner valve 14 closed. This blocking lever 24 is formed by an arm unitary with and projecting radially from a disk 25 engaged on a guide pin 26 for the end of the spring 23 braced against the housing 21 of the lighter. The disk 25 forms the hub of the blocking lever 24 and the pin 26 forms the pivot axis parallel to the axis of the burner valve 14.

Associated with the blocking lever 24 is a return spring which in the illustrated example of the drawing is formed by a radial extension 23*a* of the end of the spring 23 braced against the housing 21 of the lighter. In order that it function to return the lever 24 to the blocking position, the helical spring 23 is blocked against rotation by lugs 27 formed to this end on the lower face of the service end 15*b* of the lever 15 against which the other end of the spring 23 is braced. The radial extension 23*a* of the spring 23 (see FIG. 8) is engaged in a longitudinal notch 28 formed to this end in a section of a cylindrical skirt 29 carried by the hub 25 of the blocking lever 24 concentrically with its pivot axis 26. Naturally the free end 24*a* of the blocking lever 24 is set up so that it can be actuated from outside the housing 21 of the lighter.

As is particularly visible in FIG. 7 this end 24*a* projects laterally from the housing 21 of the lighter between the housing of same and the service end 15*b* of the rocking lever 15.

Figure 8:
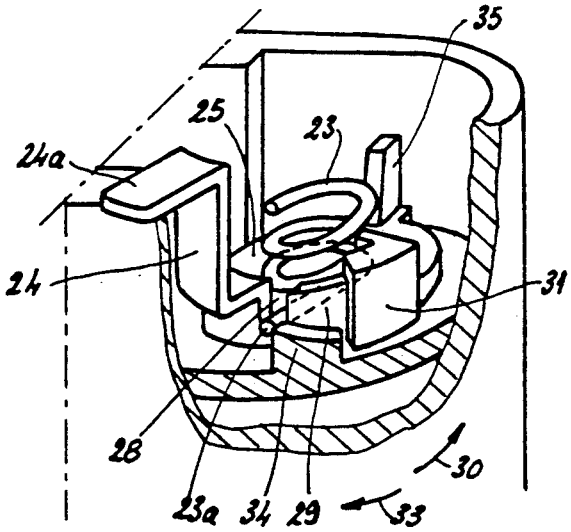
FIG. 8 is a partial perspective view partly broken away of the part of the lighter of FIGS. 5 through 7 showing the means for neutralizing the igniting mechanism.
Figure 9:
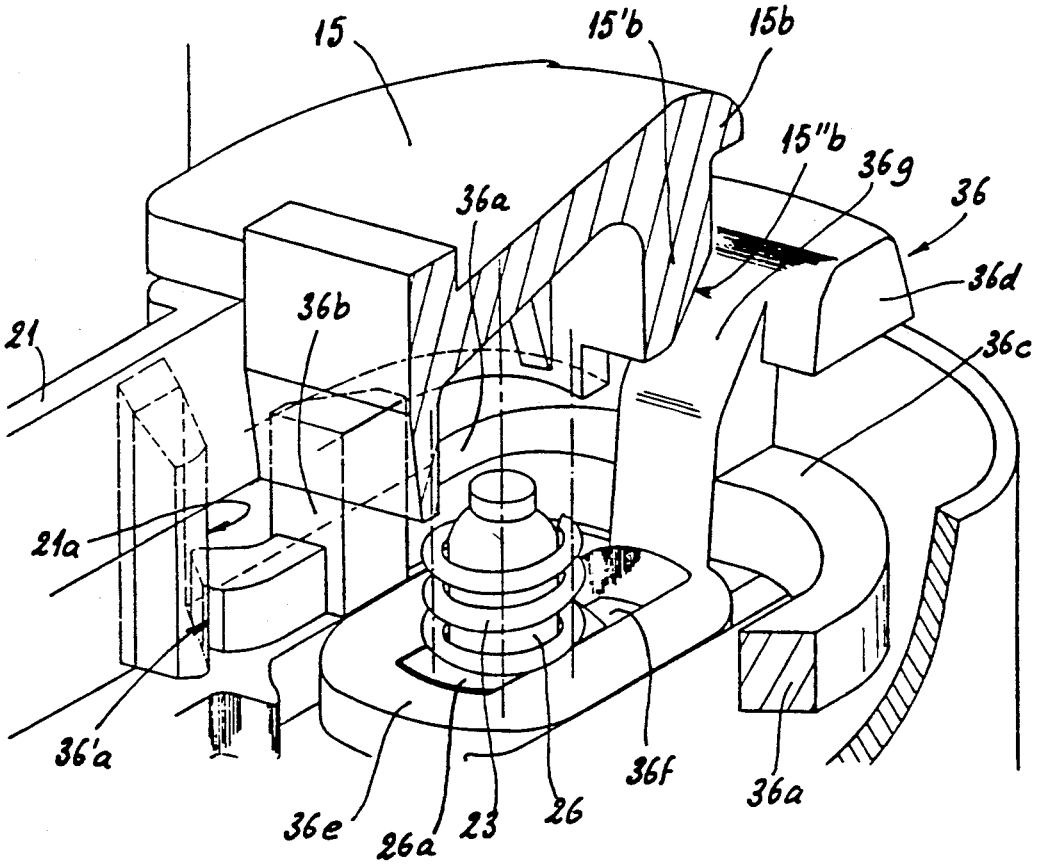
FIG. 9 is a partly broken-away perspective view showing a variant of the embodiment of the lighter of FIGS. 5 through 8.

When the lighter is assembled the spring 23 is prestressed such that it acts continuously on the blocking lever 24 in the direction of arrow 30 of FIGS. 6 and 8 so that it is constantly trying to return the lever 24 in this direction.

As shown in the drawing the hub 25 of the blocking lever 24 has a first nonaxial projection 31 which is angularly placed on the hub 25 so as to be located in position A of FIG. 6 when the lever 24 is in the normal blocking position. In this position this projection 31, which extends toward the lower face of the service end 15*b* of the lever 15, is aligned with a complementary projection 32 directed toward it and formed on the lower face of the service end 15*b* of the lever 15. In this position of the projection 31 which is shown in dashed lines in FIG. 5, which is the position that it occupies when the blocking lever 24 is at the end of its travel in the direction of arrow 30, that is the service position, any actuation of the rocking lever 15 is rendered impossible because in this position the complementary projection 32 that it carries is engaged against the projection 31 of the blocking lever 24.

In order to actuate the lever 15 it is therefore necessary to move the blocking lever 24 in a direction opposite that indicated by arrow 30 that is to say in the direction of arrow 33 of FIGS. 6 and 8. During this movement the projection 31 of the lever 24 is moved away from the projection 32 of the rocking lever 15 but, in order to permit actuation of this latter, it is necessary to neutralize at least temporarily the return spring 23*a* of the blocking lever 24. To this end the housing 21 of the lighter has as shown in particular in FIGS. 6, 7, and 8 a projection 34 having a flank lying in the path of the radial extension 23*a* of the spring 23 so as to be engaged by this radial extension 23*a* whenever the blocking lever 24 is moved in the direction of arrow 23 but which holds it after being engaged as illustrated in FIGS. 5 through 8.

In this retracted or ineffective position of the blocking lever 24 the projection 31 is no longer aligned with the projection 32 of the rocking lever 15 and the return spring 23 of the blocking lever 24 is neutralized by the projection 34, so that the rocking lever 15 can be moved and the burner valve 14 opened.

As described above means is provided for freeing the return spring 23*a* from the blocking lever 24 after actuation of the rocking lever 15. This means is simply formed by a boss 35 carried by the hub 25 of the blocking lever 24 at a location diametrically opposite that of the lever 24. In addition as shown in particular in FIG. 7 the inside face of the hub 25 is formed with an angled surface 25*a* underneath the boss 35. The result is that when the blocking lever 24 is in the retracted position as shown in the drawing moving the rocking lever 15 in the direction of arrow 22 has the effect that the lower face of its service end 15*b* is brought into contact with the top of the boss 35 which has the effect of rocking the blocking lever 24 in the direction of arrow 36 of FIG. 7. By thus rocking the lever 24 the return spring 23*a* of the blocking lever 24 is lifted from the bottom of the notch 28 in which it is lodged to a level above that of the corresponding end of the projection 34.

The thus liberated spring 23*a* tries to return the blocking lever 24 into its service position by pushing on it in the direction of arrow 30. Naturally as long as the end 15*b* of the rocking lever 15 is pushed in the force of the return spring 23*a* of the blocking lever 24 will be limited because it will be stopped in its travel by the projection 32 of the rocking lever 15. However as soon as the rocking lever 15 is freed and returned by its return spring 23 to the position closing the burner valve 14, its radial extension 23*a* which acts on the blocking lever 24 escapes and can return the blocking lever 24 at the end of its travel in the direction of arrow 30, that is into its normal blocking position.

Escape of the radial extension 23*a* of the spring 23 from the projection 32 of the rocking lever 15 is facilitated by providing a bevel 32*a* at the extreme end of this projection 32 and on its side so as to ensure a temporary retention of the radial extension 23*a* of the spring 23. It is necessary to note that this bevel 32*a* of the projection 32 also serves to facilitate the engagement underneath itself of the projection 31 of the blocking lever 24 and thus ensures a solid blocking of the rocking lever 24.

The igniting mechanism of this lighter is normally neutralized by the blocking lever 24 and putting it into its service position requires as in the preceding example of FIGS. 1 to 4 a particular movement of the free end 24*a* of the lever 24, a movement which is not obvious for a child.

FIGS. 9 through 18 show a variant of the gas lighter according to the invention, a variant of the same type as that illustrated in FIGS. 5 through 8. In these FIGS. 9 through 18 the same references as in FIGS. 5 through 8 have been used to indicate the corresponding elements. The control means for operating the burner valve, not shown in the drawing, are formed by a rocking lever 15 pivoted on a fixed axis 16 orthogonal to the axis of the burner valve by means of two gudgeons 17 which are carried on the sides of its central part and which are engaged in sockets 18 formed in a cap whose sides 19 are unitary with the housing 21 of the lighter.

As described with reference to the example of the lighter illustrated in FIGS. 5 through 8, rocking of the lever 15 in the direction corresponding to a push in the direction of arrow 22 on the service end or rear end 15*b* has the effect of opening the burner valve.

As in the above-mentioned example a helical spring 23 continuously maintains the lever 15 in the position with the burner valve closed due to the force it exerts on the service end 15*b* of this lever in a direction opposite to that of the arrow 22. The end of the spring 23 opposite the actuating end 15*b* of the rocking lever 15 is engaged on the guide and centering pin 26.

Figure 10:
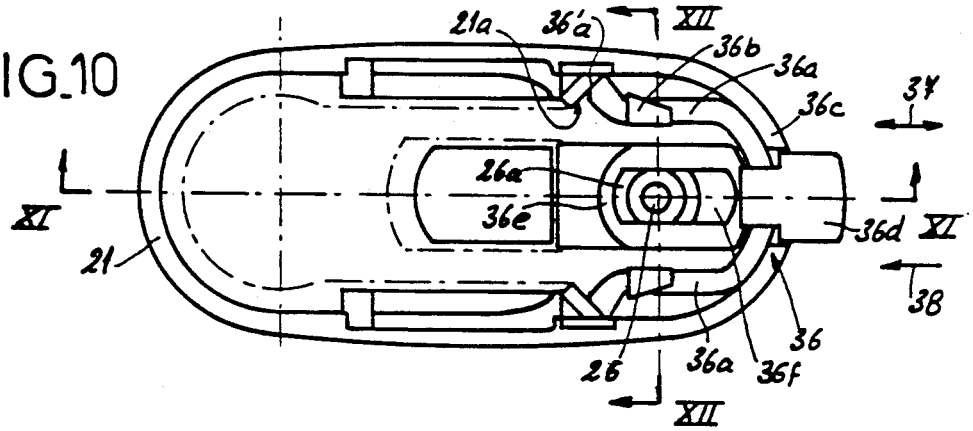
FIG. 10 is a top plan view of the object of FIG. 9, with the rocking lever retracted and the slide in the service neutralizing position.
Figure 11:
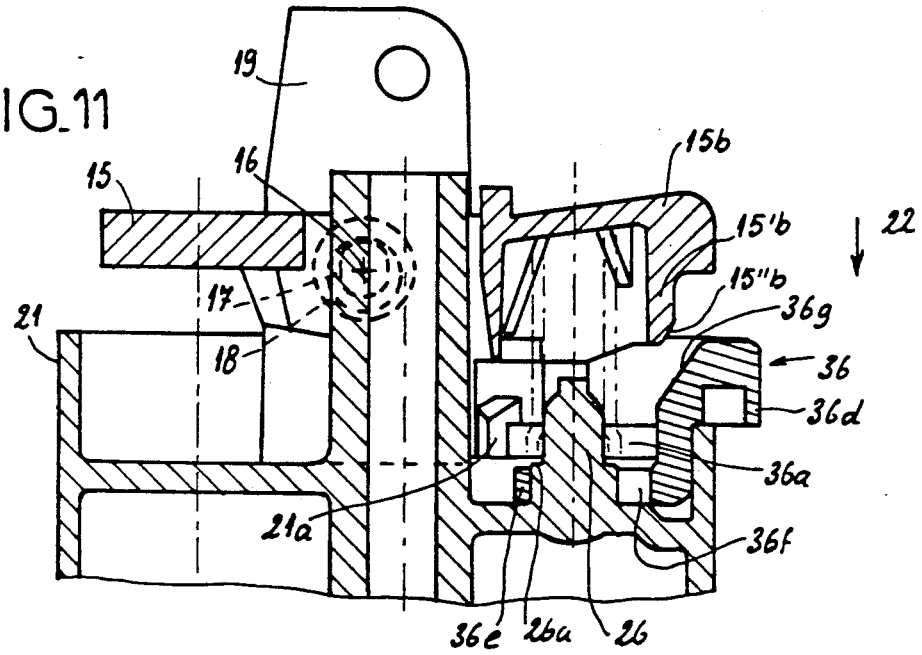
FIG. 11 is a section taken along line XI—XI of FIG. 10.
Figure 12:
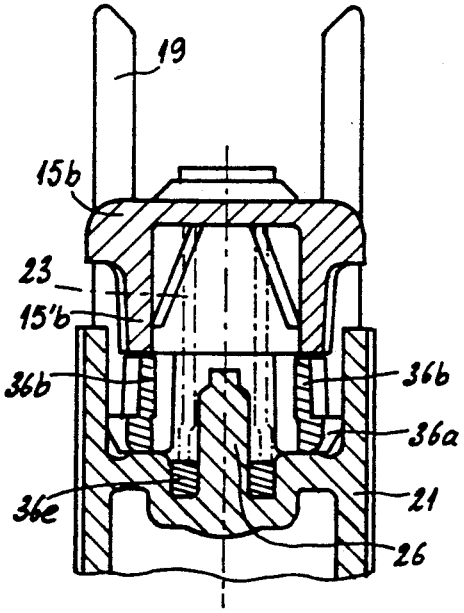
FIG. 12 is a section taken along line XII—XII of FIG. 10.

In this example the means for neutralizing the igniting mechanism is set up to oppose actuation of the rocking lever 15 in the direction of the arrow 22. In this example this neutralizing means is formed by a slide 36 moveable in the two directions illustrated by the arrow 37, that is toward and away from the burner valve between two end positions of which the one illustrated in FIGS. 10 to 12 is the active neutralizing position for the igniting mechanism, that is the position in which it opposes any movement of the rocking lever 15, while its other end position illustrated in FIGS. 13 to 15 corresponds to the retracted position in which movement of the lever 15 is made possible.

As is the case for the rocking lever 24 of the embodiment of FIGS. 5 through 8, the slide 36 is located under the service end 15*b* of the rocking lever 15. This slide 36 is located under the service end 15*b* of the rocking lever 15. This slide 36 is generally shaped like a horseshoe having elastic side arms 36*a* normally taking the spread position shown in FIG. 10, a position in which their free ends are braced against the inside faces of the upper ends of the side walls of the housing 21 of this lighter.

Each side arm 36*a* of the slide 36 carries on its upper face a boss 36*b* extending toward the service end 15*b* of the rocking lever 15 and in the normal position illustrated in FIGS. 10 to 12 the pins 36*b* are just below a skirt 15'*b* which bounds the lower face of the actuating end 15*b* of the rocking lever 15. In this position of the slide 36 any movement of the rocking lever 15 in the direction of the arrow 22 is thus made impossible. In addition a bight 36*c* of the slide 36 has a projection 36*d* extending toward the rear of the housing of the lighter and which normally projects below the actuating end 15*b* of the lever 15 as shown in FIG. 10. This same bight portion 36*c* of the slide 36 carries in addition a central medial portion 36*e* extending in the opposite direction to that of the projection 36*d* and formed with a longitudinal aperture 36*f* intended to be engaged over the guide pin 26 of the spring 23 below same as shown in particular in FIG. 11. In this regard it is noted that in order to avoid that the pressure of the spring 23 interferes with movement of the slide 36 in the direction of the arrow 37 the pin 26 has at its base a shoulder 26*a* at least partly of a width corresponding to that of the aperture 36*f* of the central medial portion 36*e* of the slide 36 but smaller than the passage of the spring 23. Naturally the height of the shoulder 26*a* is at least equal to the thickness of the central medial portion 36*e* of the slide 36. As shown in the drawing and more particularly in FIGS. 10, 13, and 16, the free ends of the side arms 36*a* of the slide 36 are bevelled so as to present converging flanks 36'*a* while the inside faces confronting the upper ends of the side wall of the housing 21 of the lighter have complementary flanks 21*a* against which the flanks 36'*a* of the lateral branches 36*a* of the slide 36 normally engage as shown in FIG. 10.

Figure 13:
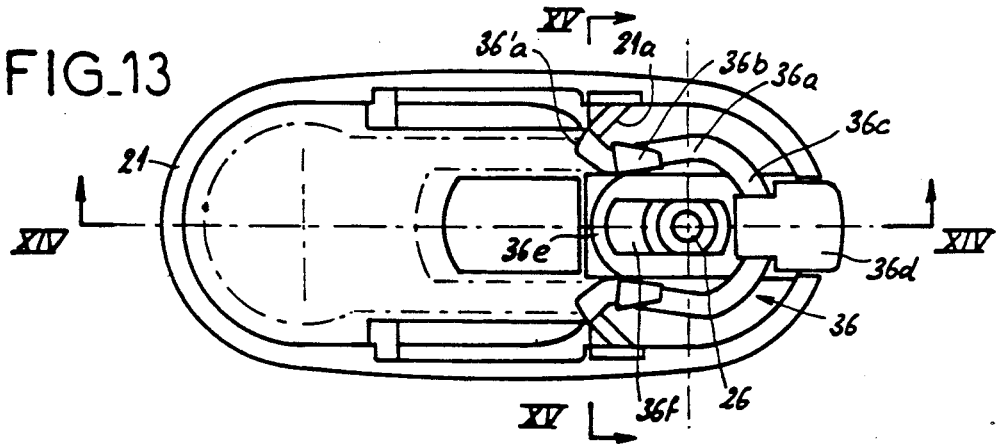
FIG. 13 is a top plan view similar to FIG. 10, the slide being retracted.
Figure 14:
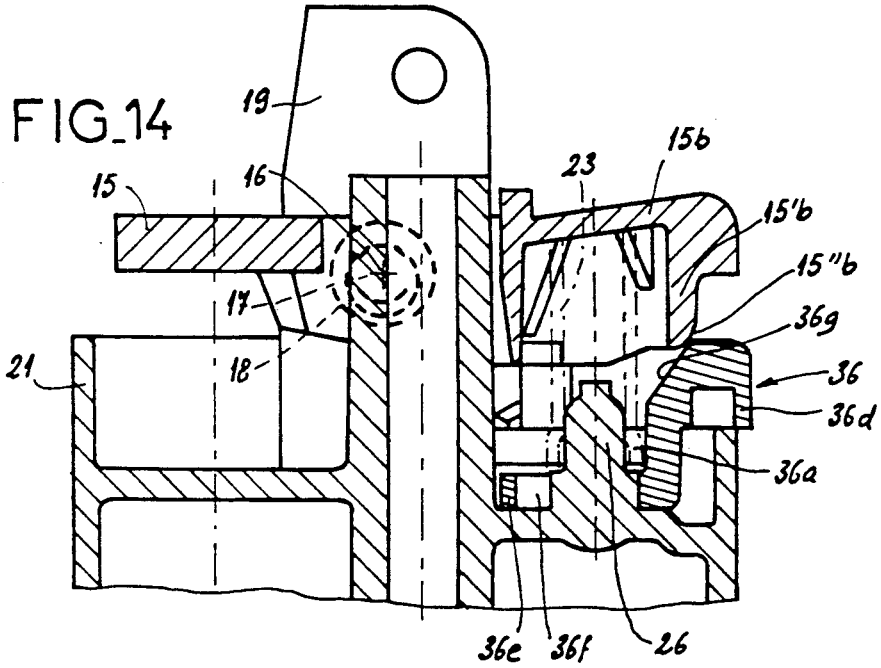
FIG. 14 is a section similar to FIG. 11 taken along line XIV—XIV of FIG. 13.
Figure 15:
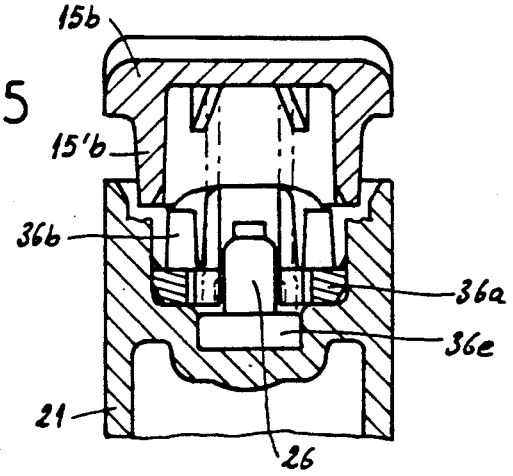
FIG. 15 is a section taken along line XV—XV of FIG. 13.
Figure 16:
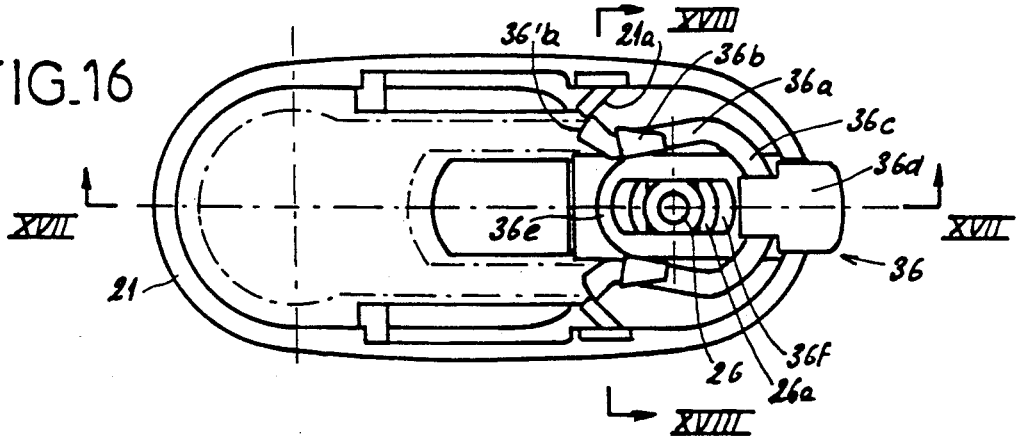
FIG. 16 is a top plan view similar to FIGS. 10 and 13, with the slide in position for igniting the flame.
Figure 17:
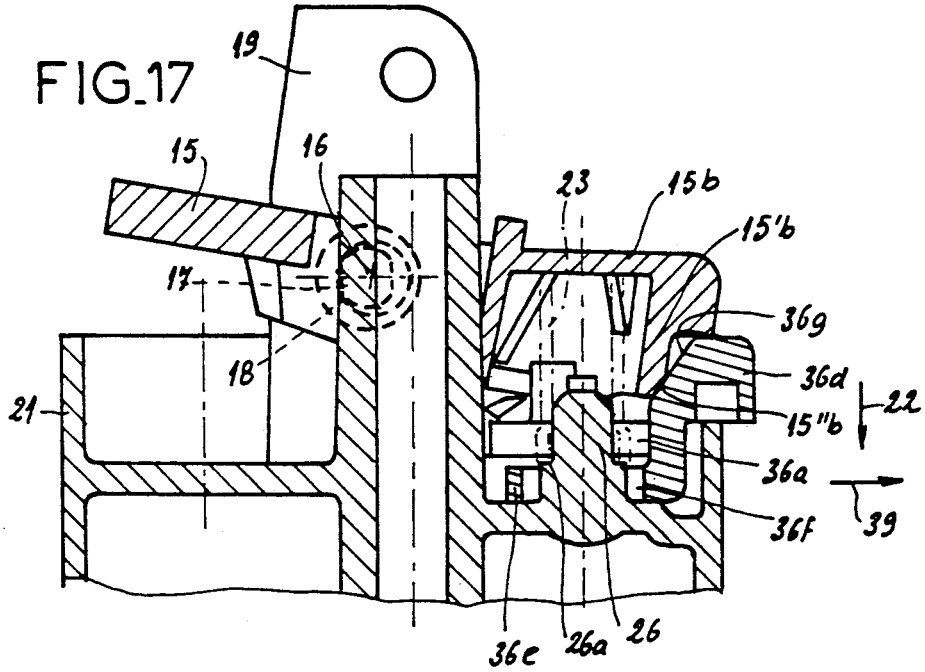
FIG. 17 is section similar to FIGS. 11 and 14 taken along line XVII—XVII of FIG. 16.
Figure 18:
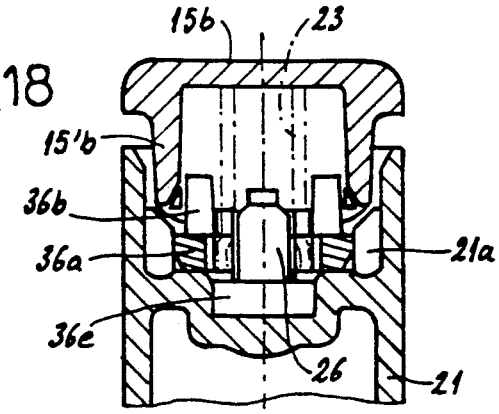
FIG. 18 is a section taken along line XVIII—XVIII of FIG. 16.

It is therefore easy to see that movement of the slide 36 by acting on its rear projection 36*d* in the direction of the arrow 38 has the effect of sliding the flanks 36'*a* of these side arms 36*a* along the flanks 21*a* of the walls of the housing 21 of the lighter and of thus provoking a squeezing-together of the arms 36*a* into the approached position shown in FIG. 13, that is in the position in which the free ends of the side arms 36*a* of the slide 36 have gone past the flanks 21*a* of the housing of the lighter. As shown more particularly in FIG. 15, in this position of the slide 36 the bosses 36*b* carried by the side arms 36*a* are moved toward each other to a spacing such that they are no longer in the path of the corresponding parts of the lower skirt 15'*b* of the actuating end 15*b* of the rocking lever 15. This rocking lever 15 can therefore be moved in the direction of the arrow 22 to control igniting of the lighter as shown in FIG. 17. Nonetheless as shown more particularly in this figure, means is provided so that this rocking of the rocking lever 15 automatically instigates a return of the slide 36 into its position neutralizing the igniting mechanism, that is blocking the rocking lever 15. In the example illustrated in the drawing this means comprises on the one hand a flank 36*g* extending downward and toward the rear of the bight 36*c* of the slide 36 and a complementary flank 15''*b* formed on the rear and lower edge of the skirt 15'*b* which bounds the lower face of the actuating end 15*b* of the lever 15. In reality the flank 36*g* of the slide 36 is formed on the rear edge of the actuating projection 36*d* of the slide 36.

As shown more particularly in FIG. 17 it is obvious that when the actuating end 15*b* of the rocking lever 15 is moved downward, that is in the direction of arrow 22, its flank 15''*b* coacts with the ramp 36*g* of the slide 36 to displace same in the direction of the arrow 39, that is in the direction opposite that of the arrow 38. This displacement takes place obviously only at the end of rocking of the rocking lever 15 in the direction of arrow 22. It is necessary to note that at this instant nothing impedes the displacement of the slide 36 in the direction of the arrow 39 because the bosses 36*b* of the side arms 36*a* of the slide 36 slide against the inside faces of the skirt 15?*b* of the actuating end 15*b* of the rocking lever 15.

It is also necessary to note that the displacement of the slide 36 in the direction of the arrow 39 as a result of the action of the flank 15''*b* of the skirt 15'*b* on the flank 36*g* of the slide 36 is not necessarily sufficient to move the slide 36 all the way into its active neutralizing position illustrated in FIG. 10. In effect, it is enough that this displacement allows the flanks 36'*a* formed at the free ends of these side arms 36*a* to engage the flanks 21*a* of the sides of the housing 21 of the lighter in order that the reciprocal action of the flanks 36'*a* and 21*a* define the end of the travel of the slide 36 in the direction of the arrow 39.

This last embodiment has in contrast to those described before the important advantage of only needing a single additional piece relative to a lighter not provided with this safety device for childproofing. In addition it is important to note that this latter embodiment of the lighter has the advantage of not interfering with automatic testing systems for the lighter as they leave the factory such as checking the flame, checking operation, and checking flame extension.

I claim:

1. A gas lighter comprising:

a housing adapted to hold a supply of combustible gas;

a nozzle on the housing adapted to emit a jet of the gas;

valve control means including a valve on the housing connected between the nozzle and the supply and actuatable to feed the gas along a nozzle axis from the supply to the nozzle, a rocking lever rocking on a fixed axis orthogonal to the nozzle axis and having one arm formed like a fork or elastic crown engaged under a collar of the valve and another arm intended to be operated by the user by being pushed in a direction toward the housing of the lighter against the force of a return spring;

ignition means on the housing adjacent the valve actuatable for forming a spark and igniting the jet therewith, the ignition means being associated with the lever for opening the valve;

a blocking slide on the housing displaceable between a neutralizing position preventing actuation of the ignition means and a freezing position permitting the ignition means to be actuated, whereby when the blocking slide is in the neutralizing position the lighter cannot be lit, the slide being positioned under the operating end of the rocking lever and movable parallel to this rocking lever between an actuated position in which it projects with respect a service end of the lever and a retracted position in which it is retracted toward an opposite end of the rocking lever, this slide being provided with guide means relative to the housing of the lighter having the shape of a horseshoe whose elastic legs carry a boss normally provided under a skirt bounding the service end of the rocking lever so as to impede rocking thereof in a direction to open the burner valve, converging complementary flanks being formed on the inside faces of the side walls of the housing of the lighter and on the external faces of the slide to reduce the spacing of their bosses when the slide is moved into the retracted position so as to completely free the path of the skirt of the service end of the rocking lever, a transverse leg of the slide and a rear outside face of the skirt of the service end of the rocking lever having complementary flanks of the same slope that can cooperate with each other when this end of the rocking lever is pushed in to move the slide in the opposite direction into its actuated neutralizing position.

2. Lighter according to claim 1, characterized in that the guide means includes a longitudinal aperture in the slide and a pin including a shoulder on said housing and extending through said longitudinal aperture, portions of said slide adjacent said longitudinal aperture engaging said shoulder.

3. Lighter according to claim 2, including a return spring having a passage therethrough for said rocking lever and diameter of the shoulder being greater than that of the passage of this spring so as to form an abutment for it.

* * * * *